United States Patent [19]

Tresselt

[11] Patent Number: 4,962,383

[45] Date of Patent: Oct. 9, 1990

[54] LOW PROFILE ARRAY ANTENNA SYSTEM WITH INDEPENDENT MULTIBEAM CONTROL

[75] Inventor: Carl P. Tresselt, Towson, Md.

[73] Assignee: Allied-Signal Inc., Morris Township, N.J.

[21] Appl. No.: 669,555

[22] Filed: Nov. 8, 1984

[51] Int. Cl.[5] ..... H01Q 00/00

[52] U.S. Cl. ..... 343/700 MS; 343/829; 343/830; 343/853

[58] Field of Search ..... 343/700 MS, 829, 830, 343/853

[56] References Cited

U.S. PATENT DOCUMENTS

| | | | |
|---|---|---|---|
| 3,308,468 | 3/1967 | Hannan | 343/779 |
| 3,710,329 | 1/1973 | Mailloux | 343/853 |
| 4,101,901 | 7/1978 | Kommrusch | 343/853 |
| 4,128,839 | 12/1978 | McComas | 343/112 TC |
| 4,257,050 | 3/1981 | Ploussions | 342/372 |
| 4,315,262 | 2/1982 | Achmpora et al. | 342/372 |
| 4,316,192 | 2/1982 | Acoraci | 343/100 SA |
| 4,318,107 | 3/1982 | Pierrot et al. | 343/700 MS |
| 4,401,988 | 8/1983 | Kaloi | 343/700 MS |
| 4,414,550 | 11/1983 | Tresselt | 343/700 File |
| 4,454,514 | 6/1984 | Itoh et al. | 343/853 |

OTHER PUBLICATIONS

J. H. Dunlavy, Jr., "New High-Frequency Antenna: The passive Network Array", Electronics, Jan. 3, 1964, pp. 32–36.

C. D. LaFond, "Promising Array Developed, Successfully Tested, Then Dropped", Missiles and Rockets, Mar. 9, 1964, pp. 33–35.

*Primary Examiner*—William L. Sikes
*Assistant Examiner*—Robert E. Wise
*Attorney, Agent, or Firm*—Howard G. Massung; Robert A. Walsh

[57] ABSTRACT

An array antenna system has been described incorporating a plurality of antenna elements each having two quarter wave patches or monopoles for radiating microwave energy in a forward and reverse direction, a first and second beam forming network coupled to a coupler for each antenna element, wherein microwave energy coupled to the antenna element from one beam forming network couples lagging phase to one of the two quarter wave patches and from the second beam forming network couples lagging phase to the other quarter wave patch. The invention overcomes the problem of antenna utilization by providing two autonomous beam patterns with independent control or for overcoming the problem of antenna pattern performance by providing a second pattern which may be combined with the first pattern to provide, for example, an improved front-to-back ratio.

12 Claims, 5 Drawing Sheets

FIG. 2
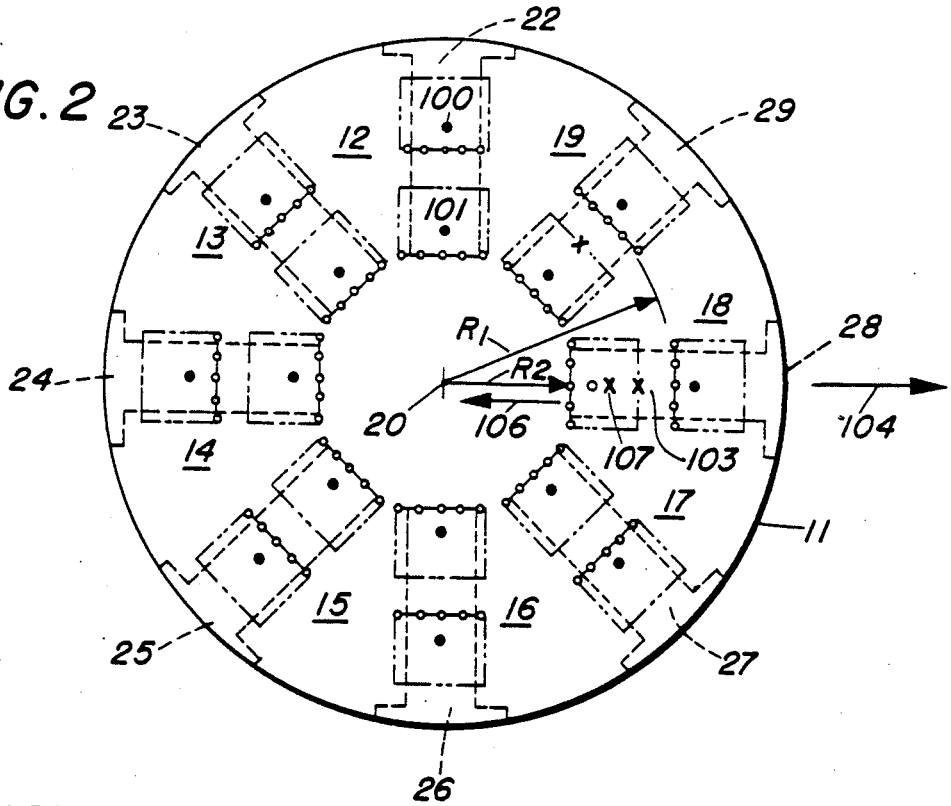
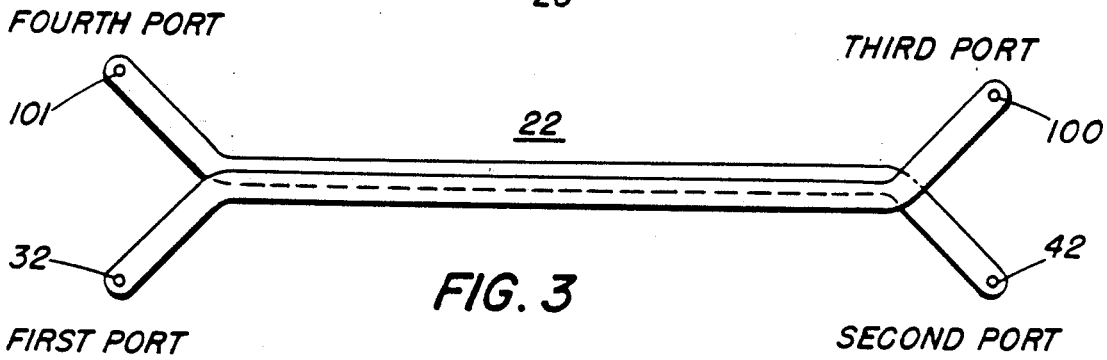
FIG. 3
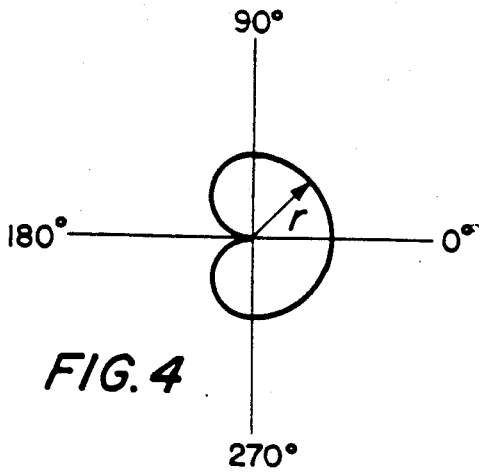
FIG. 4
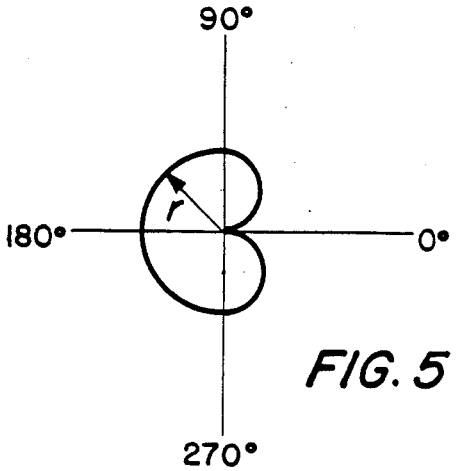
FIG. 5

FIG. 11
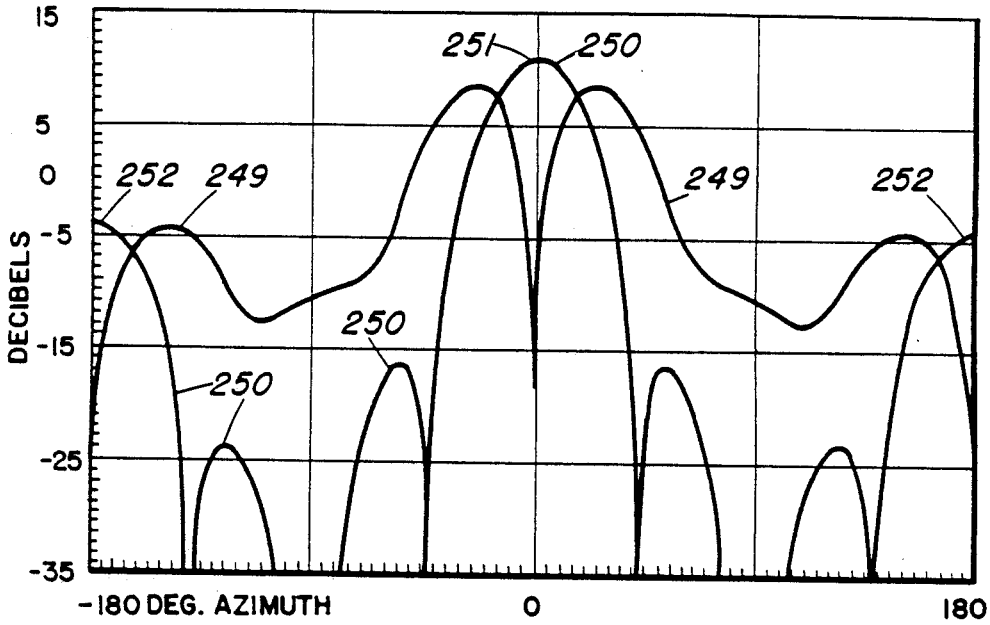
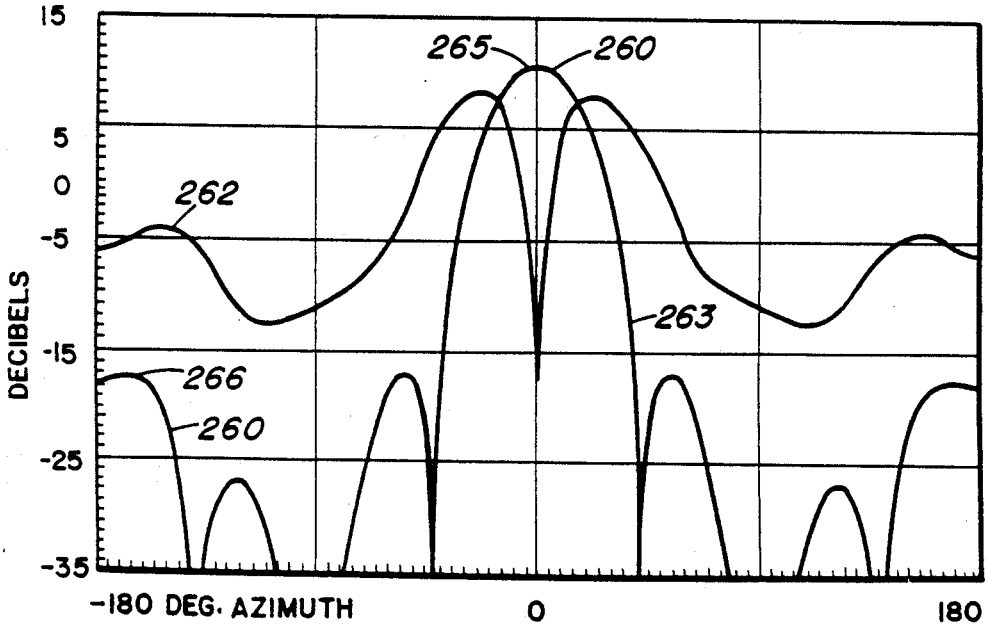
FIG. 12

LOW PROFILE ARRAY ANTENNA SYSTEM WITH INDEPENDENT MULTIBEAM CONTROL

BACKGROUND OF THE INVENTION

1. Field of the Invention:

This invention relates to array antennas and more particularly to the formation of multiple beams with independent control circuitry.

2. Description of the Prior Art:

In U.S. Pat. No. 4,318,107 which issued on Mar. 2, 1982 to R. Pierrot et al. a microstrip monopulse antenna is described for providing independent sum and difference channels. The microstrip antenna as shown in FIG. 2 of '107 includes a plurality of microstrip radiating elements or "pads", a feeding/receiving circuit and a connecting means for connecting the feeding circuit to a predetermined feed point of each radiating element. A central microstrip radiating element provides a sum channel and at least one pair of radiating elements positioned symmetrically with respect to the central radiating element provides a difference channel. The respective feed points of the radiating elements have a predetermined eccentricity with respect to the zero field radio center of the radiating element in the axis of polarization defined by the eccentricity of the feedpoint of the central radiating element.

In U.S. Pat. No. 4,316,192 which issued on Feb. 16, 1982 to J. H. Acoraci. a beam forming network is shown in FIGS. 3 and 7 for providing sum and difference patterns having omnidirectional sidelobes. The beam forming network is coupled through phase shifters for steering the beam and through a Butler matrix for adapting the beam to a circular array antenna. The circular array antenna may include 64 dipole elements where eight columns of 8 dipole elements each are equally spaced around a metal cylinder which comprises the ground plane. The cylinder may be 5" in diameter.

In U.S. Pat. No. 4,128,839 which issued on Dec. 5, 1978 to A. D. McComas, a circular array antenna is shown in FIG. 3 consisting of 8 monopoles mounted above a ground plane with an upstanding portion forming a cylinder internal of the 8 dipoles which acts as a reflector. In FIG. 4 the monopoles are shown coupled through an 8 port Butler matrix to phase shifters which in turn are coupled to a passive beam forming network which may, for example, form a sum and difference pattern.

In a publication entitled "New High-Frequency Antenna: The Passive Network Array" by J. H. Dunlavy, Jr. Electronics, Jan. 3, 1964, pages 32–36, an end-fired coupled array consisting of two closely spaced end loaded dipole elements is described with currents of equal amplitude having a relative phase difference equal to 180° minus the dipole spacing in electrical degrees. In FIG. 2, on page 35, the minimum front-to-back ratio measured at 10 MHz frequency is approximately 15 db.

It is known in the art by those practicing antenna design that a flat microstrip or patch dipole antenna arranged parallel to and in close spaced relationship with a ground plane conductor will exhibit a broad side antenna pattern, that is, a generally hemispheric antenna pattern on the dipole side of the ground plane with the ground plane forming the flat side of the hemisphere. If, however, two such patch dipoles, for example, are each arranged in the same close spaced relationship with and parallel to a ground plane conductor, separated from one another by a quarter wavelength of their operating frequency and have their feed points connected through a quarter wave phase delay, the two dipoles will form an end firing antenna element, whose antenna pattern will be directed generally along a line connecting common points on the dipoles and in the direction of phased delay.

In a publication entitled "Promising Array Developed, Successfully Tested, Then Dropped" by C. D. LaFond, Missiles and Rockets, Mar. 9, 1964, pages 33–35, a multiple-beam cylindrical array is described which makes possible for the formation of simultaneous multiple beams from a cylindrical array through the use of lossless passive transmission line networks. When the cylindrical array is used for multiple beam output, the antenna elements of the cylindrical array are excited by respective isolated network inputs. Each network input is associated with a beam in a specific direction and all beams are dispersed symmetrically throughout the 360° azimuth angle.

It is therefore desirable to provide two beam forming networks for generating antenna patterns wherein one beam forming network is coupled to an array of antenna elements for radiating an antenna pattern in a forward direction and a second beam forming network is coupled to the same array of antenna elements for generating an antenna pattern in a reverse direction.

It is further desirable to provide an array of antenna elements subdivided into a plurality of subarrays, wherein each subarray comprises two radiating elements.

It is further desirable to provide a low profile antenna wherein two antenna elements comprise a subarray for radiating microwave energy in the forward direction in response to a first signal and for radiating energy in a reverse direction in response to a second signal.

It is further desirable to provide a plurality of subarrays arranged in a circle on a radius to provide a low profile circular array.

It is further desirable to provide a plurality of subarrays positioned along a path wherein the path could be along a flat, cylindrical, spherical or conical surface for radiating energy in a first direction in response to a first input and a second direction in response to a second input.

SUMMARY OF THE INVENTION

An apparatus and method is described for radiating microwave energy comprising an array of antenna elements, a plurality of couplers having first and second input ports and third and fourth output ports, each coupler having a third port coupled to one of the antenna elements and a fourth coupled to another one of the antenna elements to form a plurality of antenna subarrays, a first beam forming network for generating a plurality of first input signals representative of a first predetermined pattern to be radiated, a second beam forming network for generating a plurality of second input signals representative of a second predetermined pattern to be radiated, the plurality of first input signals coupled to the first input port of the plurality of couplers, respectively, the plurality of second input signals coupled to the second input port of the plurality of couplers, respectively.

The antenna subarrays may comprise two radiating elements which end fire in a first direction and a second direction in response to signals at two isolated input ports respectively of a hybrid coupler having output ports coupled to the two antenna elements. The subarrays may be positioned around the perimeter of a circle to provide an outward and reverse or inward radiated beam or positioned along a linear or curved path to provide a forward and reverse radiated beam transverse to the path.

BRIEF DESCRIPTION OF THE DRAWING

FIG. 2 is a top view of a circular array antenna.

FIG. 3 is a top view of a backward wave hybrid coupler.

FIG. 4 is a subarray element pattern.

FIG. 5 is a subarray element pattern.

FIG. 11 is a computer generated graph of the simulated performance of the embodiment in FIG. 10 using one beam forming network.

FIG. 12 is a computer generated graph of the simulated performance of the embodiment in FIG. 10 using two beam forming networks.

FIG. 13 is a cross section view along the line XIII—XIII of FIG. 2.

FIG. 14 is a plan view of a monopole antenna with top loading.

FIG. 15 is a cross-section view along the line XV—XV of FIG. 14.

FIG. 16 is a plan view of ground plane 11.

FIGS. 17 and 20 are cross-section views along the line XVII—XVII of FIG. 16.

FIGS. 18, 19 and 21 are cross-section views along the line XVIII—XVIII of FIG. 16".

DESCRIPTION OF THE PREFERRED EMBODIMENT

Figure 1:
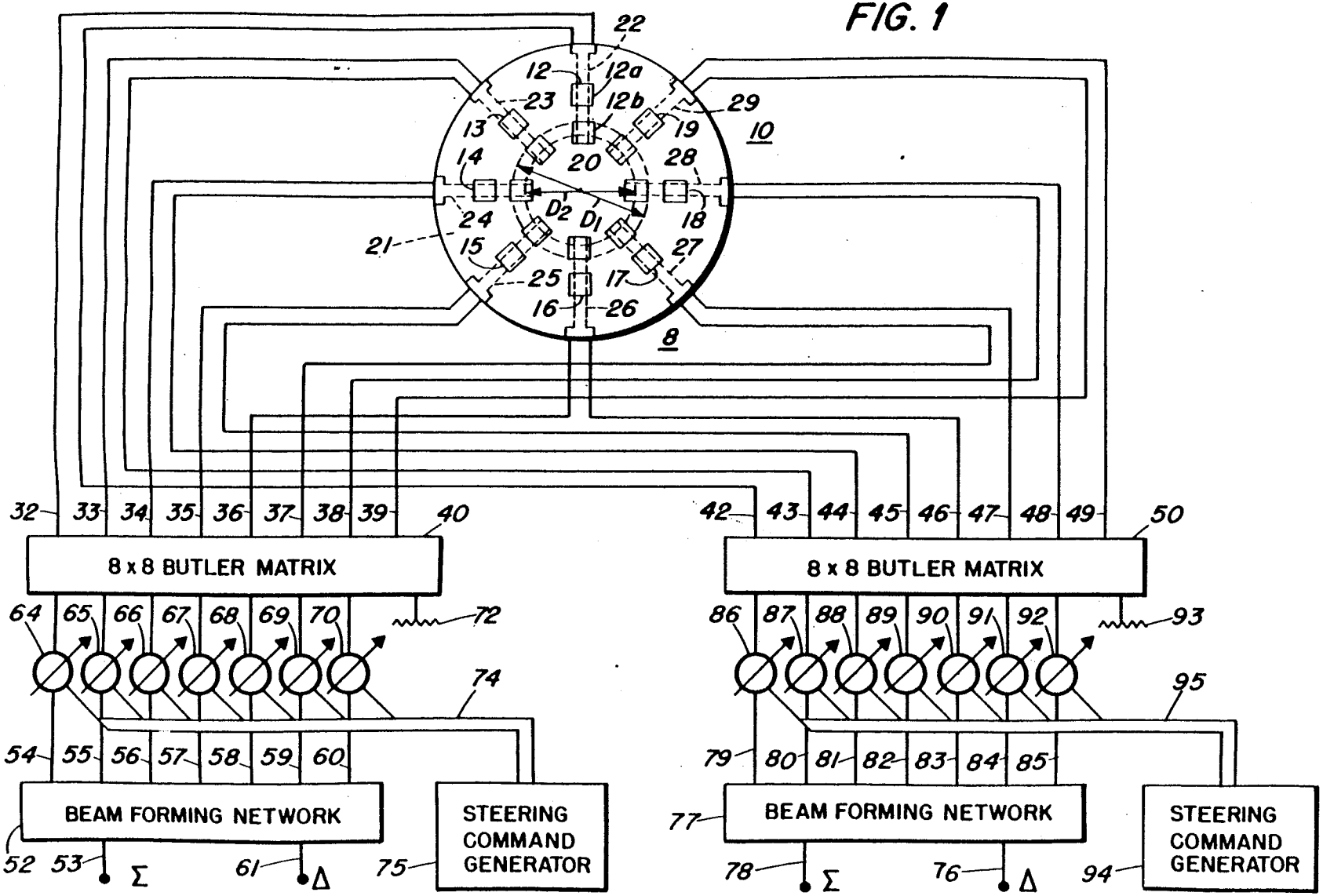
FIG. 1 is a block diagram of one embodiment of the invention.

Referring to FIG. 1, a block diagram of array antenna system 8 is shown. Antenna 10 which may be, for example, a low profile circular array antenna having a ground plane 11 which may be flat, round, spherical, or conical in shape and antenna elements 12–19. Antenna elements 12–19 each may comprise two quarter wave patch dipoles such as 12*a* and 12*b* for element 12 having one edge grounded to ground plane 11. Antenna elements 12–19 are disposed so that there mean phase centers are equally spaced on a circle of diameter D about a center 20. Antenna elements 12–19 are each fed from a four port hybrid coupler which may be positioned below ground plane 11 on the opposite surface from antenna elements 12–19. Couplers 22–29 have a first port coupled over lines 32–39 to respective outputs of 8×8 Butler matrix 40. Couplers 22–29 have a second port coupled over lines 42–49 to respective outputs of 8×8 Butler matrix 50. Butler matrix 40 and Butler matrix 50 function as a signal transformer which, in the present embodiment, transforms multiple weighted input signals with a linear phase gradient to steered input signals for a circular array. One example of a matrix is shown in detail at page 11–66 of the Radar Handbook edited by M. I. Skolnik and published in 1970 by the McGraw-Hill Book Co.

Beam forming network 52 which may, for example, receive microwave energy over line 53 may, for example, function to provide a sum beam over lines 54–60. The microwave energy arriving on line 53 is weighted to ultimately produce a sum beam from array antenna 10. Likewise, microwave energy received on line 61 is weighted by beam forming network 52 to produce a difference beam on lines 54–60. Lines 54–60 are coupled through phase shifters 64–70, respectively, to respective inputs of Butler matrix 40. Although an eight port Butler matrix is used, only seven variably phase shifted signals are applied thereto. An eighth Butler matrix port is terminated by characteristic impedance 72 to absorb any out of balance signals and an unused +3 high order circular mode as known to those skilled in the art. The antenna beam from beam forming network 52 is steered by command signals received by phase shifters 64–70 via lines 74 from steering command generator 75. Steering commands from steering command generator 75 may, for example, steer the antenna beam emitted from antenna 10 toward a fixed, remote, transponding station whose position is being tracked by means of signals received therefrom. Phase shifters 64 through 70 may be, for example, conventional 6 bit phase shifters to allow the antenna to be steered to a plurality of 64 distinct positions. Other known steering techniques will permit the pattern emitted by antenna 10 to be effectively steered continuously through 360°.

A second beam forming network 77 receives microwave energy on line 78 which is weighted by beam forming network 77 to provide a beam, such as a sum beam, on lines 79–85. Beam forming network 77 may also receive microwave energy over line 76 which may be weighted by beam forming network 77 to provide a difference beam over lines 79–85. Lines 79–85 are coupled through phase shifters 86–92, respectively, to respective inputs of 8×8 Butler matrix 50. An eighth input to Butler matrix 50 is terminated by impedance 93. The antenna beam or pattern from beam forming network 77 is steered by command signals from steering command generator 94 which is coupled over lines 95 to phase shifters 86–92. Steering commands from steering command generator 94 may be independent of or dependent on steering commands from steering command generator 75.

Reference is made to U.S. Pat. No. 4,414,550 which issued on Nov. 8, 1983 to Carl P. Tresselt, the inventor herein and assigned to The Bendix Corporation, now merged into Allied Corporation entitled "Low Profile Circular Array Antenna and Microstrip Elements Therefor" which is incorporated herein by reference to provide detail examples of components applicable to the embodiments herein.

Referring to FIG. 2, a top view of circular array antenna 10 is shown. Couplers 22–29 have a third port coupled to the outward quarter wave patch of antenna elements 12—19, respectively. Couplers 22–29 have a fourth output port coupled to the inward quarter wave patch of antenna elements 12–19. As may be seen in FIG. 2, antenna elements 12–19 extend radially outward from center 20. The inward edge of each quarter wave patch is coupled to ground as shown in FIG. 2. An outward ring of eight patches are shown equally spaced apart on radius R1. The inward patch is shown equally spaced apart on an inner radius R2. The feed points of the inner and outer patch occur at the same radius, respectively.

FIG. 13 is a cross-section view along the line XIII—XIII of FIG. 2. Quarter wave patch dipoles 12*a* and 12*b* have one edge grounded to ground plane 11 such as by plated through holes 271 and 272 formed in dielectric layer 273. Lines 100 and 101 connect coupler 22 to quarter wave patch dipples 12a and 12b at feed points 100' and 101', respectively. Backward wave coupler 22 may be made of strip line. Dielectric layer 274 may be a printed circuit board holding lines 42 and 100. Dielectric layer 275 may be 0.030 cm (0.012 in) thick. Dielectric layer 276 may be a printed circuit board holding line 101 and ground plane 277.

Referring to FIG. 3, the top view of a −3d*b* backward wave coupler 22 is shown which may also be used for couplers 23–29. This particular design is commonly called a crossover coupler, based on the arrangement of the ports. The first port on line 32 is isolated from the second port on line 42. When an input signal of one volt amplitude at 0° phase is provided on line 32, the third port on line 100 provides an output having the amplitude of $1/\sqrt{\ }$ at −90° phase and the fourth port, line 101, provides an output having the amplitude of $1/\sqrt{\ }$ with 0° phase. When an input signal of one volt amplitude and of 0° phase is presented on the second port, line 42, the third port has an amplitude $1/\sqrt{\ }$ at 0 phase and the fourth port has an output of $1/\sqrt{\ }$ at −90° phase.

FIG. 4 shows a subarray element pattern for outward radiation from center 20 of antenna 10 such as, for example, antenna element 18 shown in FIG. 2. In FIG. 4 the radius represents amplitude and the polar angle represents direction. The phase center from antenna element 18 is shown at point 103 which occurs at the outward edge of the inward quarter wave patch of antenna element 18. Point 103 may, for example, occur at a radius of 5.25" with respect to the center at point 20. The outward radiation as shown by arrow 104 in FIG. 2 corresponds to 0° direction in FIG. 4 and results from a signal over line 38 in FIG. 1, which is coupled to the first port of coupler 28 which may be identical to coupler 22 shown in FIG. 3. In a preferred embodiment coupler 22 is modified in a manner well known in the art to provide substantially one-third power ($1/\sqrt{3}$ voltage) at the 0° phase port and two-thirds power ($\sqrt{2}/\sqrt{3}$ voltage) at the −90° phase port.

Referring to FIG. 5 a subarray element pattern is shown corresponding to reverse radiation at 180° as shown by arrow 106 from antenna element 18 shown in FIG. 2. In FIG. 5 the radius represents amplitude and the polar angle represents direction. The phase center for the reverse direction wave has been estimated to be at point 107 shown in FIG. 2, which is at a radius of about 4.35" where point 20 is the center The reverse radiation, as shown in FIG. 5, corresponds to a signal coupled over line 48 to the second port of coupler 28.

In operation if a microwave signal is coupled to the first port of couplers 22–29 antenna elements 12–19 will radiate in the outward direction away from point 20. If microwave energy is coupled to the second port of couplers 22–29 the radiant energy from antenna elements 12–19 will radiate inwardly towards point 20 and beyond It is noted that the phase center of the radiated energy radiated outwards from antenna elements 12–19 occur on a radius of 5.25". The phase center of the radiated energy radiated inward to and past point 20, the reverse direction originate from antenna elements 12–19 on a different radius of an estimated 4.35". The performance of antenna 10 by coupling a signal to the second port of each element 12–19 has been simulated on a computer.

Figure 6:
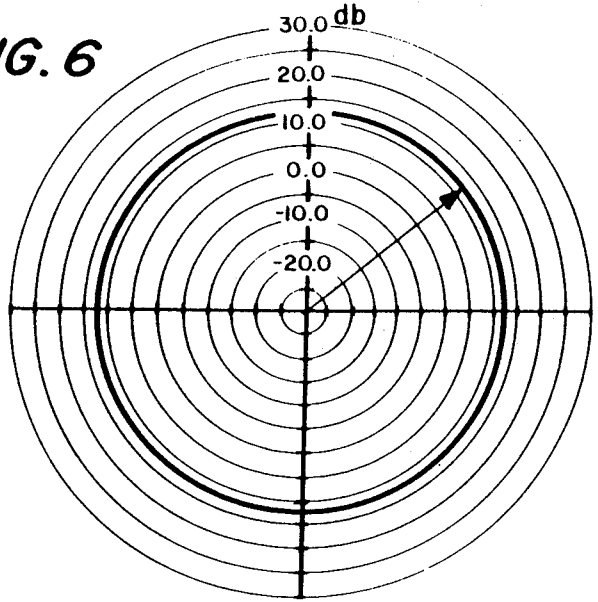
FIGS. 6, 7, 8, and 9 are computer generated graphs of the performance of the embodiment in FIG. 1.
Figure 7:
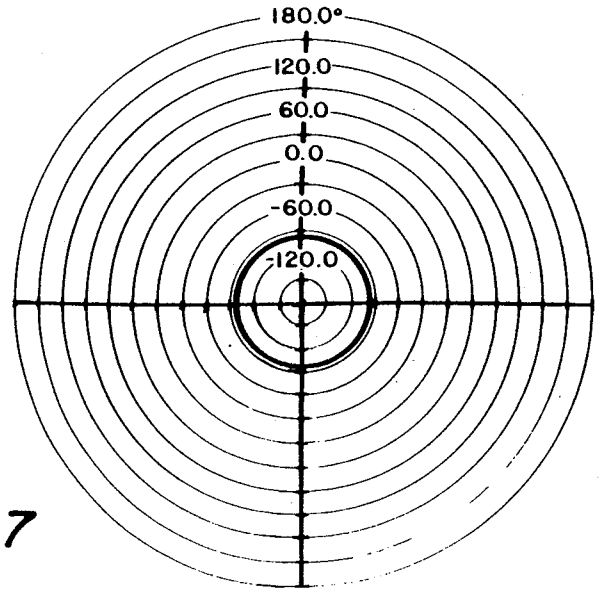
Figure 8:
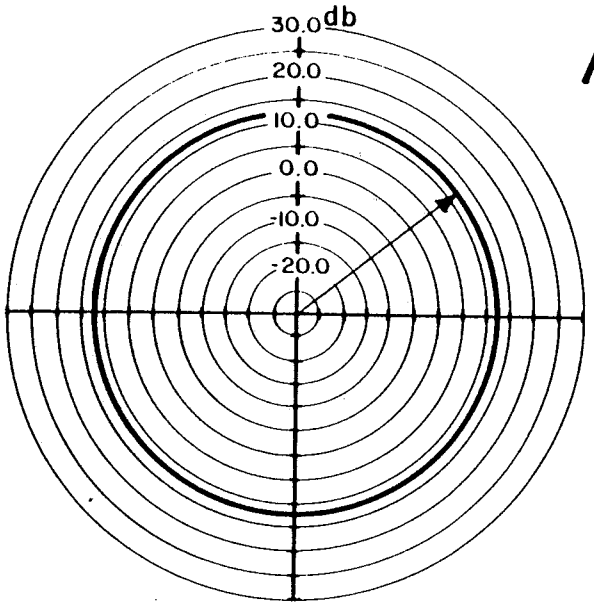
Figure 9:
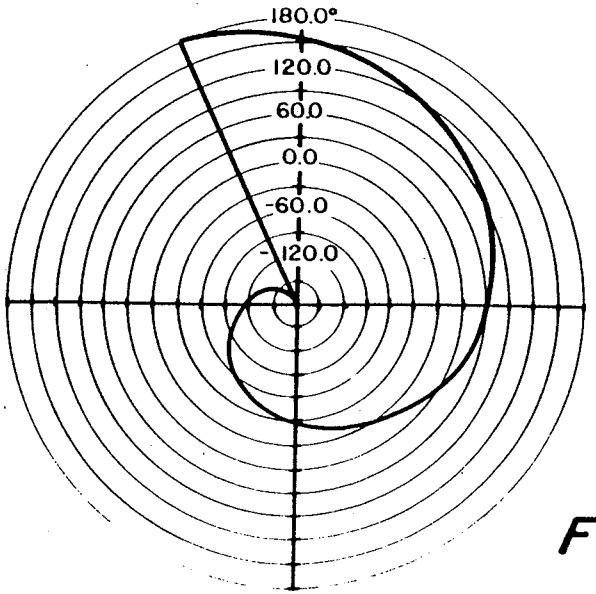

Referring to FIGS. 6–9 computer generated graphs from the simulation are shown of the performance of antenna 10 for inward or reverse radiation where the second port of couplers 22–29 are fed. The patch nearest center point 20 has the lagging phase. In FIGS. 6 and 8 the radius represents amplitude in decibels and the polar angle represents direction. In FIGS. 7 and 9, the radius represents phase in degrees and the polar angle represents direction.

The patterns simulated are those which are generated by individually exciting ports on Butler matrix 50 with a signal at 1090 MHz. FIGS. 6 and 7 show the pattern radiated for excitation of the so-called mode 0, which consists of equal amplitude and phase being applied to all eight elements. A very omnidirectional pattern with phase of −97.0002° mean with + or −.0019° pertubations having eight poled symmetry is exhibited. In FIGS. 8 and 9 a mode 1 pattern is simulated. Here equal amplitude is applied to all elements, but with phase of progressive increments of 45°. In FIG. 8 the amplitude is shown to be essentially equal in all directions, while FIG. 9 shows a nicely linear phase total progression of 360° as a function of direction, as expected of mode 1 in a properly working circular array which would ordinarily be comprised of elements radiating outward. In like manner, it can be shown that the patterns resulting from feeding modes through + and −3 are of the same quality as those produced by exciting outward pointed beams by individually exciting the ports on Butler matrix 40. One is thus assured that a reasonable set of reverse sum and difference beams can be synthesized in a manner similar to that used for the forward pointing beams. It can be shown that the amplitude of the various modes being simultaneously excited by beam forming network 77 are very similar to the corresponding set of modes excited by network 52. Only the phasing is substantially changed in providing the proper sum and difference reversed beams.

Figure 10:
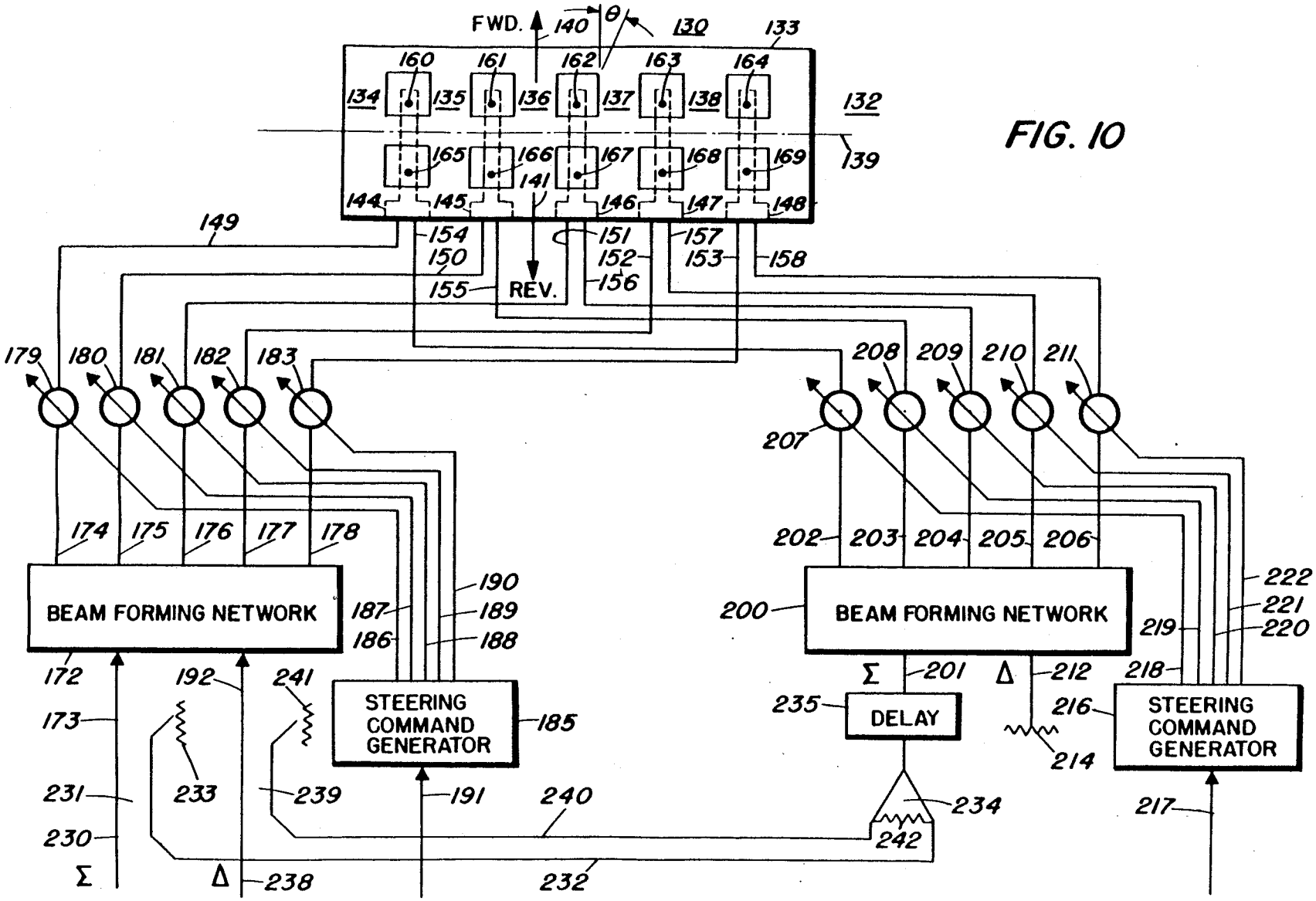
FIG. 10 is a block diagram of an alternate embodiment of the invention.

Referring to FIG. 10, an array antenna system 130 is shown. Antenna 132 has a ground plane 133 with antenna elements 134–138 positioned along a path 139. Antenna elements 134–138 each comprise two quarter wave patch dipoles which are spaced apart to provide radiation in a forward direction shown by arrow 140 and radiation in the reverse direction shown by arrow 141. Antenna elements 134–138 receive microwave energy by means of couplers 144–148. Couplers 144–148 have a first port coupled to lines 149–153, respectively. Couplers 144–148 have a second port coupled to lines 154–158, respectively. A third port of couplers 144–148 are coupled to the forward quarter wave patch at feed points 160–164, respectively. The fourth port of couplers 144–148 are coupled to feed points of the quarter wave patch in the reverse direction of antenna elements 134–138 at feed points 165–169. Couplers 144–148 may, for example, be a backward wave coupler such as shown in FIG. 3.

Two quarter wave patches which have a spacing and phase delay between them which add up to 180° will provide an end fire radiation path, such as shown in FIGS. 4 and 5. The quarter wave patch exhibiting the lagging phase, such as −90° will be the patch with the direction of radiation. Signals coupled over lines 149–153 will provide a lagging phase to forward quarter wave patch at feed points 160–164 causing antenna elements 134–138 to radiate in the forward direction Signals coupled over lines 154–158 will couple a lagging phase to the reverse quarter wave patch at feed points 165–169, causing antenna elements 134–138 to radiate in the reverse direction as shown by arrow 141.

Beam forming network 172 may generate a beam from microwave energy coupled over line 173 which is apportioned over lines 174–178 to provide a beam such as a sum pattern, which is coupled through phase shifters 179–183 and over lines 149–153 to antenna 132. Steering command generator 185 provides control signals over lines 186–190 to phase shifters 179–183, respectively. Steering command generator 185 may, for example, in response to a control signal over line 191, steer the beam represented by signals on lines 74–178 to a predetermined direction $\theta$ with respect to the forward direction of antenna 132. Beam forming network 172 may also receive microwave energy on line 192 which may be apportioned by beam forming network 172 to form a difference signal represented by signals on lines 174–178.

A second beam forming network 200 may receive microwave energy over line 201 and apportion the energy on output lines 202–206. Lines 202–206 are coupled through phase shifters 207–211 to lines 154–158. Beam forming network 200 may be identical to beam forming network 172, wherein the difference beam on line 212 if not desired may be terminated by impedance 214. Steering command generator 216, in response to a control signal on line 217, provides control signals over lines 218–222 to the control input of phase shifters 207–211.

Steering command generator 185 may be independent of steering command generator 216. Beam forming network 172 may be independent of beam forming network 200. Due to the coupling to antenna elements 134-138, beam forming network 172 results in the beam being radiated in the forward direction as shown by arrow 140, while the beam generated by beam forming network 200 results in a beam radiated in the reverse direction as shown by arrow 141.

FIG. 10 shows a specific interconnection of signals between the two independent beam forming networks 172 and 200. This is for purposes of correcting a flaw found in the performance of the dual patch elements. The perfect cardiod shapes shown in FIGS. 4 and 5 are difficult to realize in the geometry of a linear array such as shown in FIG. 10, with the patch pairs radiating undesired energy out the rear, leaving a non-perfect front-to-back ratio due to effects such as mutual coupling between the patches, as is well understood in the art. Changing the value of the coupling in the coupler from the ideal equal power split to one in which two-thirds of the power is fed to the patch in the direction of radiation with the remaining one-third applied to the rear patch does help improve the front-to-back ratio, which still may be only 15 db. In this example, the rearward radiating pattern is devoted to correcting the effects of this flaw on the sum and difference performance of the forward looking beams from the array.

Microwave energy may be coupled in on line 230 and pass through coupler 231 to line 173 and to line 232. The other port of coupler 231 is terminated in impedance 233. The signal on line 232 passes through Wilkenson divider 234 through delay 235 to line 201. The signals on lines 173 and 201 may correspond to a sum pattern. Microwave energy may be coupled over line 238 through coupler 239 to line 192 and to line 240. The fourth port of coupler 239 may be terminated in impedance 241. Line 240 is coupled through Wilkenson divider 234 which combines the signal on line 240 with the signal on line 232 prior to passing the signals through delay 235. Wilkenson divider 234 has a resistor 242. Wilkenson divider 234 functions as a power combiner.

Couplers 231 and 239 may be adjusted such that the signal on line 173 is at −0.18 db with respect to the signal on line 230 and the signal on line 232 is at −14 db. Likewise, the signal on line 192 may be at −0.18 db with respect to the signal on line 238 and the signal on line 240 is at −14 db with respect to the signal on line 238. Due to the attenuation of Wilkenson combiner 234 the signal on line 201 is at −17 db with respect to the signals on lines 230 and 238.

FIG. 11 is a computer generated graph of the performance of antenna 132 using only beam forming network 172 with a sum and difference pattern being generated. In FIG. 11 antenna 132 may have antenna elements 134–138 mounted on a conical section having a radius of 24" and an apex of approximately 10' if extended. Antenna elements 134–138 are positioned equally apart along the perimeter of the conical section such as a circular arc. In FIG. 11 the abscissa represents angular direction in degrees and the ordinate represents amplitude in decibels. In FIG. 11 the difference pattern as shown by curve 249 drops below the value of the sum curve 250 at 162° and at −164° drops below −35 db at 180°. Thus, the region directly behind the boresight at 180° does not provide a well behaved sum and difference pattern. One is referred to U.S. Pat. No. 4,316,192 of J. H. Acoraci for a discussion of the desirability of keeping the difference beam pattern above the sum beam in all but one direction.

Referring to FIG. 12, a computer generated graph is shown of the simulated performance of the embodiment in FIG. under the same conditions as in FIG. 11, except that beam forming network 200 is activated. In FIG. 12 the ordinate represents amplitude in decibels and the abscissa represents angular direction in degrees. Table I shows the voltages and phase coupled to the first and second ports of couplers 144–148 for the sum beam.

TABLE I

| | Σ BEAM | | | | | |
|---|---|---|---|---|---|---|
| | Forward Beam | | | Reverse Beam | | |
| Antenna Element | Line | Volts | Phase | Line | Volts | Phase |
| 134 | 149 | .2260 | 0° | 154 | .0319 | 180° |
| 135 | 150 | .4770 | 0° | 155 | .0674 | 180° |
| 136 | 151 | .6310 | 0° | 156 | .0892 | 180° |
| 137 | 152 | .4770 | 0° | 157 | .0674 | 180° |
| 138 | 153 | .2260 | 0° | 158 | .0319 | 180° |

Table II shows the voltages and phase for the difference beam coupled to the first and second ports of couplers 144–148.

TABLE II

| | Δ BEAM | | | | | |
|---|---|---|---|---|---|---|
| | Forward Beam | | | Reverse Beam | | |
| Antenna Element | Line | Volts | Phase | Line | Volts | Phase |
| 134 | 149 | .3230 | 0° | 154 | .0319 | 180° |
| 135 | 150 | .5290 | 0° | 155 | .0674 | 180° |
| 136 | 151 | .1030 | 0° | 156 | .0892 | 180° |
| 137 | 152 | .6850 | 180° | 157 | .0674 | 180° |
| 138 | 153 | .2490 | 180° | 158 | .0319 | 180° |

Curve 260 shows the sum pattern resulting from a forward and reverse sum beam as shown by the values in Table I. Curve 262 shows the difference beam due to forward and reverse radiation according to the values in Table II. As may be seen, the difference curve remains above the sum curve 260 in regions outside the main beam 263. By steering both sets of beams in synchronism one can preserve this favorable condition for a considerable angle to each side of boresight.

Delay 235 shown in FIG. 10 provides an adjustment to compensate for different line lengths and a different phase center for the reverse radiation path as opposed to the forward radiation.

Antenna 132 may have a ground plane which is flat, cylindrical, spherical or conical Steering command generator 185 and 216 may be both steered in the same azimuth direction, one forward and one reverse, where improved sum and difference beam patterns are desired Alternatively, beam forming network 172 and steering command generator 185 may be operated autonomously with respect to beam forming network 200 and steering command generator 216. In that event, microwave energy may be coupled directly to lines 201 and 212.

FIG. 14 is a plan view of a monopole antenna 12*a*′ and FIG. 15 is a cross-section view along the line XV—XV of FIG. 14. Monopole antenna 12*a*′ has a vertical portion 280 shorter than /4 and a horizontal portion 281 to provide top (capacitive) loading to the vertical portion 280 which is inductive. Horizontal portion 282 provides mechanical support and is positioned on dielectric layer 273. Line 100 may be a short riser wire or pin to monopole antenna 12*a*′ at feed point 100′. Coupler 22 may be made of stripline positioned below ground plane 11 as shown in FIGS. 2 and 13.

FIG. 16 is a plan view of ground plane 11. FIGS. 17 and 18 are cross-section views along the lines XVII—XVII and XVIII—XVIII, respectively, showing a cylindrical surface or a conical surface.

FIGS. 17 and 19 are cross-section views along the lines XVIII—XVIII and XVIII—XVIII, respectively, showing a spherical surface.

FIGS. 20 and 21 are cross-section views along the lines XVII—XVII AND XVIII—XVIII, respectively, showing a second conical surface.

An array antenna system has been described for radiating microwave energy comprising an array of antenna elements, each having two microwave patches operated to end fire in the forward or reverse direction, a plurality of couplers having first and second input ports and third and fourth output ports, each coupler having a third port coupled to one of the antenna patches and a fourth port coupled to the other antenna patch, a first beam forming network for generating a plurality of first input signals representative of a first predetermined pattern to be radiated in the forward direction, and a second beam forming network for generating a plurality of second input signals representative of a second predetermined pattern to be radiated in the reverse direction, the plurality of first input signals coupled to the first input port of the plurality of couplers, respectively, and the plurality of second input signals coupled to the second input port of the plurality of couplers, respectively

The invention claimed is:

1. Apparatus for radiating microwave energy comprising:

an array of antenna elements, a plurality of couplers each having first and second input ports and third and fourth output ports, each said coupler having said third port coupled to one of said antenna elements and said fourth port coupled to another one of said antenna elements to form a plurality of antenna subarrays, each antenna element of each said subarray positioned substantially a quarter wavelength apart from the other antenna element at a desired operating frequency, a first beam forming network for generating a plurality of first input signals representative of a first predetermined pattern to be radiated, and a second beam forming network for generating a plurality of second input signals representative of a second predetermined pattern to be radiated, said plurality of first input signals coupled to said first input port of said plurality of couplers, respectively, said plurality of second input signals coupled to said second input port of said plurality of couplers, respectively, each said coupler including means for transmitting the first input signal from said first input port to said third and fourth output ports and for shifting the first transmitted signal at said third output port by 90° with respect to the first transmitted signal at said fourth output port, and means for transmitting the second input signal from said second input port to said third and fourth output ports and for shifting the second transmitted signal at said fourth by 90° with respect to the second transmitted signal at said third port.

2. The apparatus of claim 1 wherein each antenna element includes a patch antenna positioned over a ground plane.

3. The apparatus of claim 1 wherein each antenna element alone exhibits a substantially omnidirectional pattern.

4. The apparatus of claim 1 wherein each antenna element includes a $\lambda/4$ monopole antenna.

5. The apparatus of claim 1 wherein each antenna element includes a monopole antenna shorter than $\lambda/4$ with top loading.

6. The apparatus of claim 1 wherein said subarrays are positioned in a path along a predetermined pattern.

7. The apparatus of claim 6 wherein said pattern is a circle and wherein each subarray is equally spaced apart by a predetermined distance.

8. The apparatus of claim 7 wherein each said subarray has a predetermined orientation with said antenna elements of each subarray positioned along a respective radial line of said circle.

9. The apparatus of claim 6 wherein said pattern is over a cylindrical surface.

10. The apparatus of claim 6 wherein said pattern is over a spherical surface.

11. The apparatus of claim 6 wherein said pattern is over a conical surface.

12. Apparatus for radiating microwave energy comprising:

a ground conductor having a first and second surface, a plurality of antenna elements positioned above said first surface, each said antenna element having first and second radiators spaced substantially a quarter wavelength apart from each other at a desired operating frequency, a plurality of couplers, one for each antenna element, each coupler having first through fourth ports, said first port coupled to one of a plurality of first input signals to be radiated, said second port coupled to one of a plurality of second input signals to be radiated, said third port coupled to said first radiator of a respective antenna element, said fourth port coupled to said second radiator of said respective antenna element, a first beam forming network for generating said plurality of first input signals representative of a first predetermined pattern to be radiated, and a second beam forming network for generating said plurality of second input signals representative of a second predetermined pattern to be radiated, each said coupler including means for transmitting the first input signal from said first input port to said third and fourth output ports and for shifting the first transmitted signal at said third output port by 90° with respect to the first transmitted signal at said fourth output port, and means for transmitting the second input signal from said second input port to said third and fourth output ports and for shifting the second transmitted signal at said fourth port by 90° with respect to the second transmitted signal at said third port.

* * * * *